United States Patent [19]

McMahon

[11] 4,068,318

[45] Jan. 17, 1978

[54] WRIST BAND CONTAINING AN ANTISLIP COMPOSITION

[76] Inventor: William P. McMahon, 14416 Marmont, Chesterfield, Mo. 63017

[21] Appl. No.: 721,201

[22] Filed: Sept. 8, 1976

[51] Int. Cl.[2] ..... A41D 19/02

[52] U.S. Cl. ..... 2/170; 273/29 A

[58] Field of Search ..... 2/170; 273/29 A, 29 R, 273/26 R, 32 R, 81 R, 73, 67, 67 DA, 65 EG; 15/424; 206/813

[56] References Cited

U.S. PATENT DOCUMENTS

| | | | |
|---|---|---|---|
| 1,633,586 | 6/1927 | Hunter | 2/170 |
| 2,287,477 | 6/1942 | Israel | 15/424 |
| 3,645,008 | 2/1972 | Delsack | 273/75 |
| 3,972,528 | 2/1976 | McCracken | 273/75 |

*Primary Examiner*—Werner H. Schroeder
*Assistant Examiner*—Doris L. Troutman
*Attorney, Agent, or Firm*—Gravely, Lieder & Woodruff

[57] ABSTRACT

A wrist band has a fabric cover which is capable of assuming an annular configuration and contains a cavity. A granular antislip composition is within the cavity and will escape through the interstices of the cover when one's hand, a racket handle, or some other object is rubbed against the cover.

13 Claims, 3 Drawing Figures

FIG. 1
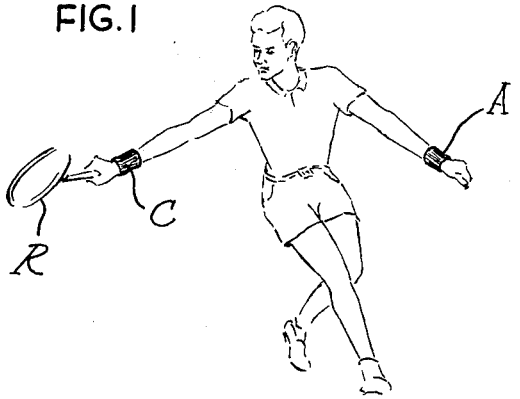
FIG. 2
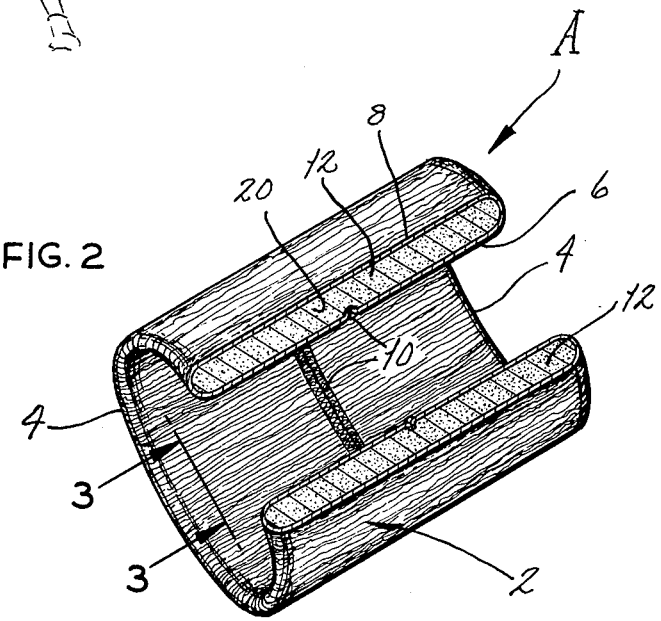
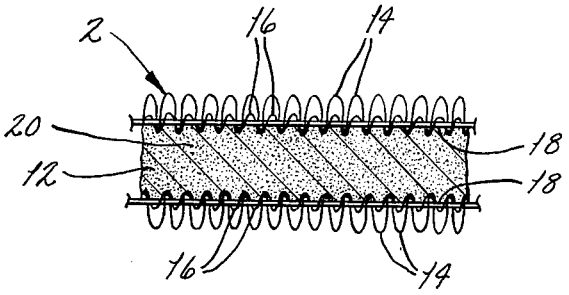
FIG. 3

WRIST BAND CONTAINING AN ANTISLIP COMPOSITION

BACKGROUND OF THE INVENTION

This invention relates in general to athletic equipment and, more particularly, to a wrist band containing an antislip composition.

Good strokes in tennis require that the racket be held with a firm grip particularly at the instant of contact with the ball. Tennis, however, is a vigorous sport which often produces quite a bit of perspiration, and this perspiration, if it reaches the handle of the tennis racket, greatly detracts from the ability of one to hold the racket with any degree of firmness. Indeed, it is not unusual for a racket having a wet handle to turn in one's hand, even when the ball is struck only slightly off center on the racket strings.

Absorbant wrist bands to a limited extent prevent perspiration from running down one's arm and onto the racket handle, but even with wrist bands it is extremely difficult to keep the racket handle entirely dry.

Other sports present similar problems. For example, in squash and racketball one must likewise maintain a firm grip on the racket handle. In baseball the batter must hold the bat firmly, lest it will slip out of his hands. The pitcher must likewise obtain a firm grip on the ball while throwing it.

Rosin bags have long been available to baseball players, usually at some inconvenient location on the playing field. These bags however are not very practical for more active sports such as tennis.

SUMMARY OF THE INVENTION

One of the principal objects of the present invention is to provide an article of manufacture which enables an athlete or other individual to have convenient access to an antislip composition. Another object is to provide an article of the type stated which is in the form of a wrist band and hence is conveniently available at the wrist of the individual. A further object is to provide a wrist band of the type stated in which the antislip composition is in dry grandular condition and is contained within the wrist band. An additional object is to provide an article of the type stated which is simple in construction and economical to manufacture. These and other objects and advantages will become apparent hereinafter.

The present invention is embodied in a wrist band including a flexible cover which has a cavity therein and is configured to fit around one's wrist. An antislip composition is in the cavity. The invention also consists in the parts and in the arrangements and combinations of parts hereinafter described and claimed.

DESCRIPTION OF THE DRAWING

In the accompanying drawing which forms part of the Specification and wherein like numerals and letters refer to like parts wherever they occur:

FIG. 1 is an illustration of a tennis player wearing a wrist band constructed in accordance with and embodying the present invention;

FIG. 2 is a perspective view, partially cut away and in section, of the wrist band; and FIG. 3 is a fragmentary sectional view taken along line 3—3 of FIG. 2 and showing the knit for the fabric cover.

DETAILED DESCRIPTION

Referring now to the drawings, A designates (FIG. 2) a wrist band for enabling an athlete or other individual to obtain a better grip on an implement, particularly if the effectiveness of the grip is diminished by perspiration. To this end, the wrist band A is formed from a porous fabric and contains an antislip composition in the form of dry granules or powder. These granules escape through the intersticies in the fabric cover so that antislip composition is readily available to the athlete. Indeed, merely by rubbing his hand over the wrist band, the athlete acquires enough of the antislip composition to firmly grip most athletic equipment. The wrist band is normally worn on the wrist of the arm which is not used to hold or grip the athletic equipment. For example, a right handed tennis player would wear the wrist band A on his left wrist (FIG. 1).

The wrist band A includes a fabric cover 2 of an annular or tubular configuration, and that cover is formed from a length of tubular fabric which is doubled back upon itself at end edges 4. Actually the fabric is turned inwardly upon itself to form an inner layer 6 and an outer layer 8 with the two layers being joined at the end edges 4. The inner layer 6 furthermore is in two sections, there being a different section extending axially from each end edge 4. The two sections are joined together along a line of stitching 10 which is located midway between the end edges 4 and is concealed by the outer layer 8. Thus, both the inner and outer layers 6 snd 8 are continuous in both the circumferential and axial directions, and furthermore enclose an annular pocket or cavity 12 which exists between them.

The fabric from which the cover 2 is formed is of the stretch variety commonly associated with conventional wrist bands, with most of the stretch being available in circumferential direction. More specifically, the fabric is formed from three types of strands or thread, namely cotton strands 14, nylon strands 16, and elastic strands 18 (FIG. 3). The elastic strands 18 extend in the circumferential direction only. The cotton strands 14 and the nylon strands 16, on the other hand, are knitted together around the elastic strands 18, with the knit being quite loose as to the cotton strands 14 so that those strands form a looped pile which stands out from the elastic and nylon strands 16 and 18. The cotton strands 14 occupy the major portion of the knit fabric and, being formed from cotton, are quite absorbant. The knit as to the nylon and cotton strands 16 and 18 is loose enough to permit the fabric to stretch a substantial distance in the circumferential direction, but not in the axial direction. Being loosely woven, the fabric of the cover 2 has a multitude of small openings or interstices in it.

While it is preferred to have the cover 2 formed from an elastic fabric which is tubular and therefor continuous in the circumferential direction, it may also be formed from two plies of terry cloth stitched together along their margins to form a cavity. The plies at their ends may be attached to Velco fasteners material so that the ends at the plies, after being wrapped around the wrist may be held together.

The annular cavity 12 between the layers 6 and 8 of the fabric cover 2 contains an antislip composition 20 in granular form. The particle size of the antislip composition 20 should be small enough to enable the granules to pass through the intersticies of knit fabric, but the nature of the composition 20 should be such that the composition 20 will for the most part be retained in the cavity unless the wrist band A is rubbed or massaged.

One material suitable for use as the antislip composition 20 is a mixture of vulcanized vegetable oil and a filler material such as talcum powder. Vulcanized vegetable oil is commonly used in connection with erasing devices employed by draftsmen to clean smudges from pencil drawings. The material is normally in a granular form and is contained in a porous bag which is rubbed over the pencil drawings. An erasing device of the foregoing nature is disclosed in U.S. Pat. No. 2,287,477. The granules of vulcanized vegetable oil tend to adhere together or clump and this tendency prevents the granules from sifting through the fabric cover 2 under normal circumstances. Indeed, the tendency to clump is usually so great that few granules of the vulcanized vegetable oil will escape from the fabric cover 2 when the cavity 12 contains only the granulated vegetable oil. The talcum powder to a limited measure counteracts the natural tendency of the granulated vegetable oil to clump, and lets it pass through the fabric cover 2 when the cover 2 is massaged.

The vulcanized vegetable oil may be prepared according to the formulation and procedure set forth in U.S. Pat. No. 2,287,477. The material is available from American Cyanamid Company which sells it for erasing purposes under the trademark FACTICE. If the material is supplied in cake form, the cake is chopped, milled, and otherwise processed to reduce it to a granular condition suitable for use in the fabric cover 2.

One vegetable oil which is particularly suitable is rapeseed oil. When that oil is used, the antislip composition should contain by volume 10 parts vulcanized rapeseed oil and between 1 and 2 parts talcum powder. About one-half cup of the antislip composition 20 is sufficient for the cavity 12.

Other vegetable oils which are suitable for use are castor oil, soy bean oil, and palm oil. Mixtures of various vegetable oils may likewise be utilized. Filler materials other than talcum powder may be used to prevent excessive clumping of the granules of vulcanized vegetable oil. Other suitable materials are powdered barium sulfate, calcium carbonates, lime, magnesium oxide, etc.

Another material which is suitable for use as the antislip composition is a mixture of vulcanized vegetable, oil filler material, and powdered rosin. About five parts by volume of the mixture of vulcanized vegetable oil and talcum powder previously discussed should be mixed with one part powdered resin. One-half cup of this composition is sufficient to fill the cavity 12 in the cover 2.

Still another suitable material for the antislip composition 20 is a mixture of powdered and granulated chips of rosin. The granules of rosin should not exceed about $\frac{1}{8}$ inch. About one-fourth cup of this antislip composition is adequate for the cavity 12 in the cover 2.

The granular antislip composition 20 is introduced into the cavity 12 at the seam which is normally closed by the stitching 10. In particular, the stitching 10 is made with the cover 2 turned inside-out so that the stitching 10 is presented outwardly. Prior to completion of the stitching 10, the granular antislip composition is introduced into the cavity 12 through the open portion of the seam. Once the cavity 12 contains the proper amount of antislip composition, the stitching 10 is completed so that it is continuous in the circumferential direction. The fabric cover 2 is then again turned inside-out so that the stitching 10 is presented inwardly. Finally the wrist band A is packaged in a suitable container such as a clear plastic bag.

The cavity 12 may also be filled with the antislip composition by spreading the knit fabric at its inner layer 6 and inserting a pointed metal or plastic nozzle through the spread portion so that the discharge end of the nozzle is within the cavity 12. The pointed end of the nozzle has an outside diameter of about $\frac{1}{4}$ inch. The nozzle itself is connected to a source of compressed air so that an airstream passes through the nozzle. The granular antislip composition is introduced into this airstream and becomes entrained in it. As a result the antislip composition is packed into the cavity 12 by air pressure.

OPERATION

The wrist band A is designed primarily for use by tennis players to prevent the racket R from slipping in the player's hand. This is achieved by placing the wrist band A around the wrist on the arm which is free, that is on the arm which does not hold the racket (FIG. 1). A conventional wrist band C may be placed around the other wrist to prevent perspiration from coming down the player's arm and onto his hand as well as the racket handle in that hand.

If the racket handle begins to slip in the racket hand, the player merely rubs or massages the wrist band A with his racket hand to extract some of the antislip composition 20 from it. The composition 20 adheres to the fingers and palm of the racket hand, and when the racket hand is again placed around the racket handle, the tendency to slip is greatly reduced. Accordingly a much firmer grip on the racket handle is acquired.

Instead of massaging the wrist band A with the racket hand, the racket handle itself may be rubbed over the wrist band A. This likewise causes granules of the antislip composition to migrate through the fabric cover 2 and adhere to the racket handle. Hence, when the handle is again gripped, the tendency to slip is substantially reduced.

While wrist band A is designed primarily for use by tennis players, it is also suitable for use by those who participate in other sports where it is desirable to obtain a firm grip on a piece of equipment, a ball, or some other object. For example, a baseball pitcher may use the wrist band A to maintain a good grip on the baseball during the delivery of the pitch. Likewise a batter may use it to lessen the chances of the bat slipping out of his hands. Squash and racketball players are also benefited by the wrist band A. Indeed, the wrist band A is useful to just about anyone who must maintain a firm grip on an object, whether it be in athletics or other endeavors, since the wrist band A is always readily available on one's person, yet does interfere with one's movement.

This invention is intended to cover all changes and modifications of the example of the invention herein chosen for purposes of the disclosure which do not constitute departures from the spirit and scope of the invention.

What is claimed is:

1. A wrist band comprising: a flexible cover capable of assuming an annular configuration and being sized to fit around one's wrist or arm, the cover having an interior pocket therein and further having openings between the pocket and the exterior of the cover; and an antislip composition in the pocket of the cover and being releasable through the openings in the cover so one may apply the antislip composition to his hand, to a racket handle, or to some other object brought against the cover.

2. A wrist band according to claim 1 wherein the cover is formed from a porous fabric and the voids are interstices in the fabric of the cover; and wherein the antislip composition is in a granular condition such that it will escape slowly through interstices in the porous fabric, whereby the antislip composition is released to the exterior of the cover where it may be applied to a hand, a racket handle, or some other object.

3. A wrist band according to claim 2 wherein the fabric of the cover is continuous in the circumferential direction and also elastic in the circumferential direction, so that it may be stretched in that direction.

4. A wrist band according to claim 2 wherein the fabric cover includes inner and outer layers which are joined together along end edges, the pocket being between the inner and outer layers.

5. A wrist band according to claim 2 wherein the antislip composition is granular.

6. A wrist band according to claim 1 wherein the antislip composition comprises vulcanized vegetable oil in a granular form.

7. A wrist band according to claim 6 wherein the antislip composition further comprises a substance to prevent the granular vulcanized vegetable oil from clumping.

8. A wrist band according to claim 7 wherein the substance to prevent the granular vulcanized vegetable oil from clumping is talcum powder.

9. A wrist band according to claim 7 wherein the antislip composition further comprises rosin.

10. A wrist band according to claim 1 wherein the antislip composition comprises rosin in a granular condition.

11. A wrist band according to claim 1 wherein the antislip composition comprises rapeseed oil in a vulcanized condition.

12. A wrist band comprising: a flexible cover formed from interwoven strands so that small openings exist in the cover, the cover having an annular configuration and being sized to fit around one's wrist or arm, the cover having inner and outer layers which are joined together along end edges so that a cavity exists between the two layers; and a granular antislip composition in the cavity with the granules being sized to escape through the small openings when one's hand, a racket handle, or other object is rubbed against the fabric cover.

13. A wrist band according to claim 12 wherein the antislip composition comprises vegetable oil which has been heated.

* * * * *